US009624767B2

(12) United States Patent
Sitka

(10) Patent No.: US 9,624,767 B2
(45) Date of Patent: Apr. 18, 2017

(54) APPARATUS AND METHOD TO PRODUCE DATA PULSES IN A DRILL STRING

(75) Inventor: Mark Anthony Sitka, Richmond, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 407 days.

(21) Appl. No.: 14/357,957

(22) PCT Filed: Nov. 14, 2011

(86) PCT No.: PCT/US2011/060618

§ 371 (c)(1),
(2), (4) Date: May 13, 2014

(87) PCT Pub. No.: WO2013/074070

PCT Pub. Date: May 23, 2013

(65) Prior Publication Data

US 2014/0307527 A1 Oct. 16, 2014

(51) Int. Cl.
*C09K 8/02* (2006.01)
*B23P 11/02* (2006.01)
(Continued)

(52) U.S. Cl.
CPC ..... *E21B 47/16* (2013.01); *E21B 47/18* (2013.01); *E21B 47/187* (2013.01)

(58) Field of Classification Search
CPC ..... E21B 47/16
See application file for complete search history.

(56) References Cited

U.S. PATENT DOCUMENTS 4,630,244 A 12/1986 Larronde
5,583,827 A 12/1996 Chin
(Continued)

FOREIGN PATENT DOCUMENTS

CN 1721655 A 1/2006
CN 101660407 A 3/2010
(Continued)

OTHER PUBLICATIONS

"European Application Serial No. 11875914.1, Office Action mailed Oct. 17, 2014", 1 pg.
(Continued)

*Primary Examiner* — Joseph Feild
*Assistant Examiner* — John Mortell
(74) *Attorney, Agent, or Firm* — Gilliam IP PLLC

(57) ABSTRACT

A method and assembly to produce data pulses in a drilling fluid in a drill string. The assembly comprises a shear valve that includes a valve member mounted in a valve passage in fluid flow communication with a fluid flow conduit of a drill string to which the assembly is connectable. The valve member is connected to a reciprocation mechanism comprising a rocker, a driven crank arrangement, and a slider member that provides a sliding coupling between the crank arrangement and the rocker. The slider member is pivotally connected to the crank arrangement, is keyed to the rocker for angular displacement about a valve axis, and is radially slidable relative to the rocker, so actuation of the crank arrangement causes angular reciprocation of the rocker, and hence of the valve member, about the valve axis, to produce data pulses in the drilling fluid.

25 Claims, 9 Drawing Sheets

(51) Int. Cl.
*E21B 47/16* (2006.01)
*E21B 47/18* (2012.01)

(56) References Cited

U.S. PATENT DOCUMENTS

| | | | | |
|---|---|---|---|---|
| 5,740,126 | A | 4/1998 | Chin et al. | |
| 5,787,052 | A | 7/1998 | Gardner et al. | |
| 6,050,349 | A | 4/2000 | Rountree et al. | |
| 6,469,637 | B1 | 10/2002 | Seyler et al. | |
| 6,626,253 | B2 | 9/2003 | Hahn et al. | |
| 6,714,138 | B1 | 3/2004 | Turner et al. | |
| 6,763,899 | B1 | 7/2004 | Ossia et al. | |
| 6,898,150 | B2 | 5/2005 | Hahn et al. | |
| 6,970,398 | B2 | 11/2005 | Lavrut et al. | |
| 6,975,244 | B2 | 12/2005 | Hahn et al. | |
| 7,250,873 | B2 | 7/2007 | Hahn et al. | |
| 7,280,432 | B2 | 10/2007 | Hahn et al. | |
| 7,327,634 | B2 | 2/2008 | Perry | |
| 7,330,397 | B2 | 2/2008 | Ganesan et al. | |
| 7,382,686 | B2 | 6/2008 | Innes | |
| 7,405,998 | B2 | 7/2008 | Webb et al. | |
| 7,468,679 | B2 | 12/2008 | Feluch | |
| 7,552,761 | B2 | 6/2009 | Moriarty | |
| 7,719,439 | B2 | 5/2010 | Pratt et al. | |
| 7,808,859 | B2 | 10/2010 | Hahn et al. | |
| 8,020,632 | B2 | 9/2011 | Moriarty | |
| 8,151,905 | B2 | 4/2012 | Song et al. | |
| 8,174,404 | B2 | 5/2012 | Hahn et al. | |
| 2002/0117306 | A1 | 8/2002 | Hahn et al. | |
| 2003/0056985 | A1* | 3/2003 | Hahn | E21B 47/18 175/48 |
| 2004/0069535 | A1 | 4/2004 | Hahn et al. | |
| 2007/0132606 | A1 | 6/2007 | Reckmann et al. | |
| 2010/0157735 | A1 | 6/2010 | Allan et al. | |
| 2011/0192009 | A1* | 8/2011 | Plunkett | E21B 4/14 29/447 |
| 2013/0088361 | A1 | 4/2013 | Pike | |

FOREIGN PATENT DOCUMENTS

| | | | |
|---|---|---|---|
| CN | 103946482 | A | 7/2014 |
| EP | 1354127 | B1 | 10/2003 |
| WO | WO-99/19594 | A1 | 4/1999 |
| WO | WO-2011011005 | A1 | 1/2011 |
| WO | WO-2013074070 | A1 | 5/2013 |

OTHER PUBLICATIONS

"European Application Serial No. 11875914.1, Response filed Mar. 18, 2015 to Office Action mailed Oct. 17, 2014", 27 pgs.

Teale, R., "The concept of specific energy in rock drilling", *International Journal of Rock Mechanics and Mining Sciences*, 2(1), (1965), 57-73.

"Chinese Application Serial No. 201180074804.0, Response filed Jul. 24, 2015 to Office Action mailed Mar. 16, 2015", (w/ English Translation of Claims), 19 pgs.

"Chinese Application Serial No. 201180074804.0, Response filed Nov. 4, 2015 to Office Action mailed Oct. 22, 2015", (w/ English Translation of Claims), 19 pgs.

"European Application Serial No. 11875914.1, Office Action mailed Mar. 23, 2016", 7 pgs.

"International Application Serial No. PCT/US2011/060618, International Search Report mailed Feb. 22, 2012", 2 pgs.

"International Application Serial No. PCT/US20118/060618, Written Opinion mailed Feb. 22, 2012", 5 pgs.

"Chinese Application Serial No. 201180074804.0, Office Action mailed Mar. 16, 2015", (w/ English Translation), 11 pgs.

"Chinese Application Serial No. 201180074804.0, Office Action mailed Oct. 22, 2015", (w/ English Translation), 11 pgs.

"Australian Application Serial No. 2011381085, Examination Report No. 1 mailed Jul. 8, 2014", 4 pgs.

"Australian Application Serial No. 2011381085, Response filed Nov. 25, 2014 to Examination Report No. 1 mailed Jul. 8, 2014", 22 pgs.

"European Application Serial No. 11875914.1, Extended European Search Report mailed Sep. 30, 2014", 4 pgs.

"International Application Serial No. PCT/US2011/060618, International Preliminary Report on Patentability mailed May 30, 2014", 7 pgs.

"European Application Serial No. 11875914.1, Response filed Jun. 13, 2016 to Office Action mailed Mar. 23, 2016", 14 pgs.

* cited by examiner

APPARATUS AND METHOD TO PRODUCE DATA PULSES IN A DRILL STRING

PRIORITY APPLICATION

This application is a U.S. National Stage Filing under 35 U.S.C. 371 from International Application No. PCT/US 2011/060618, filed on 14 Nov. 2011, and published as WO 2013/074070A1 on 23 May 2013; each of the application and the publication is incorporated herein by reference in its entirety.

BACKGROUND

Borehole fluid telemetry systems, generally referred to as mud pulse systems, serve to transmit information from the bottom of a borehole to the surface during drilling operations. For purposes of the present disclosure, all fluids that might be used in a well during the course of a drilling operation are referred to herein as "drilling fluid." Virtually any type of data that may be collected downhole can be communicated to the surface through use of mud pulses telemetry systems, including information about the drilling operation or conditions, as well as logging data relating to the formations surrounding the well. Information about drilling operations or conditions may include, for example, pressure, temperature, direction and/or deviation of the wellbore, and drill bit condition; and formation data may include, by way of an incomplete list of examples, sonic density, porosity, induction, and pressure gradients of the formation. The transmission of this information is important for control and monitoring of drilling operations, as well as for diagnostic purposes.

The data pulses may be produced by a valve arrangement alternately obstructing and opening a drilling fluid conduit provided by the drill string. Mechanisms employed in the actuation of such valve arrangements are subject to substantial wear, while a rate of data pulse production, and therefore of transmission bandwidth, may be limited by force application capabilities of an actuating mechanism that actuates the valve arrangement.

BRIEF DESCRIPTION OF THE DRAWINGS

Some embodiments are illustrated by way of example and not limitation in the figures of the accompanying drawings in which.

DETAILED DESCRIPTION

The following detailed description refers to the accompanying drawings that depict various details of examples selected to show how the present invention may be practiced. The discussion addresses various examples of the inventive subject matter at least partially in reference to these drawings, and describes the depicted embodiments in sufficient detail to enable those skilled in the art to practice the invention. Many other embodiments may be utilized for practicing the inventive subject matter other than the illustrative examples discussed herein, and structural and operational changes in addition to the alternatives specifically discussed herein may be made without departing from the scope of the inventive subject matter.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

Figure 1:
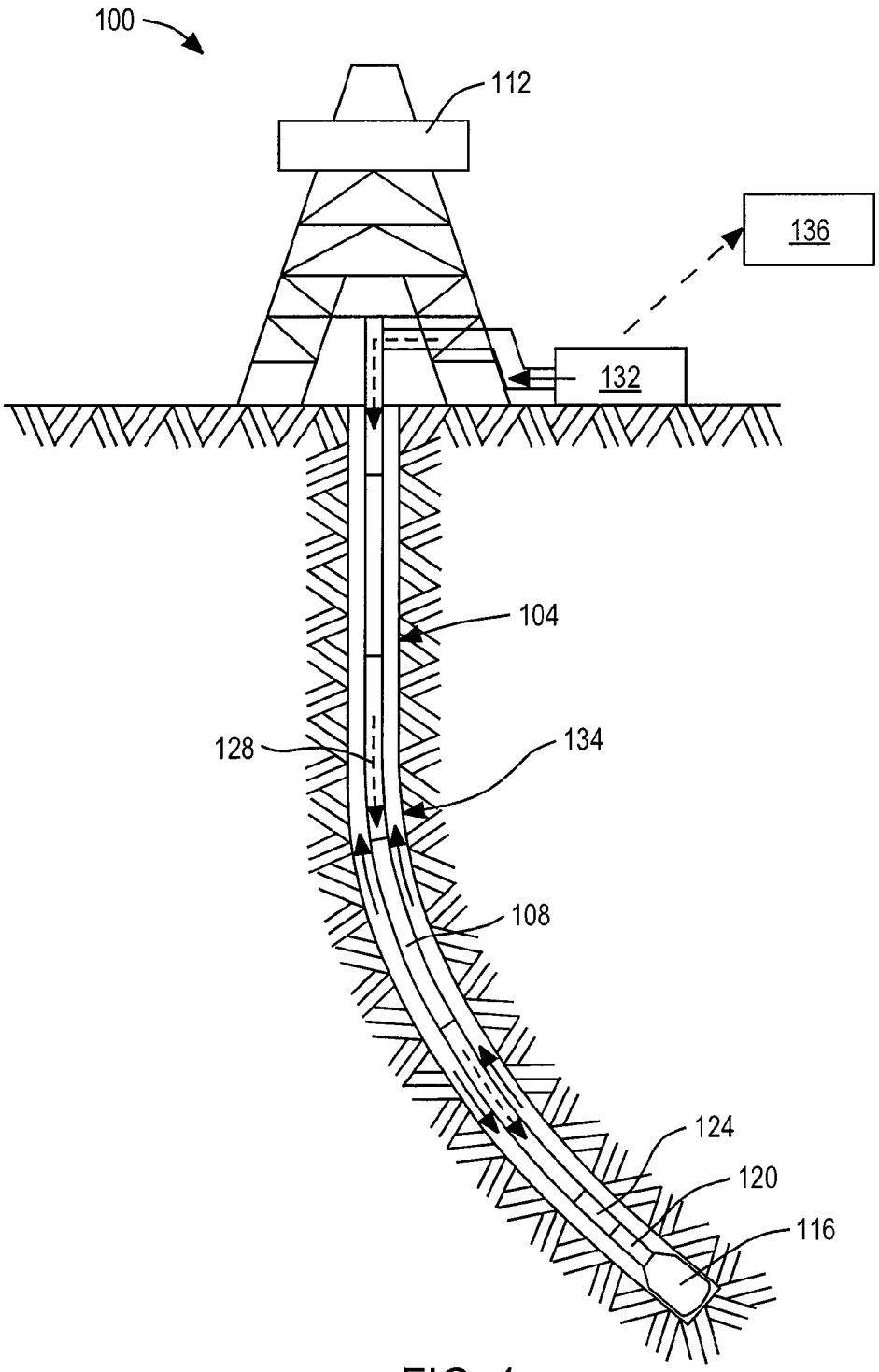
FIG. 1 depicts a schematic diagram of a drilling installation that includes a drill string including a telemetry assembly to generate data pulses in a drilling fluid, in accordance with an example embodiment.

FIG. 1 is a schematic view of an example embodiment of a system 102 to produce data pulses in a drilling fluid. A drilling installation 100 includes a subterranean bore hole 104 in which a drill string 108 is located. The drill string 108 is comprises sections of drill pipe suspended from a drilling platform 112 secured at a wellhead. A downhole assembly or bottom hole assembly (BHA) at a bottom end of the drill string 108 includes a drill bit 116. A measurement and control assembly 120 is included in the drill string 108, which also includes measurement instruments to measure borehole parameters, drilling performance, and the like. The drill string 108 includes an example embodiment of a telemetry assembly 124 that is connected in-line in the drill string 108 to produce data pulses in a drilling fluid in the drill string 108. The telemetry assembly 124 comprises an actuated valve arrangement to selectively produce data pulses in the drilling fluid, as described in greater detail below with reference to FIGS. 2-4.

Drilling fluid (e.g. drilling "mud," or other fluids that may be in the well), is circulated from a drilling fluid reservoir 132, for example a storage pit, at the earth's surface, and coupled to the wellhead, indicated generally at 130, by means of a pump (not shown) that forces the drilling fluid down a drilling fluid conduit 128 provided by a hollow interior of the drill string 108, so that the drilling fluid exits under high pressure through the drill bit 116. After exiting from the drill string 108, the drilling fluid occupies a borehole annulus 134 defined between the drill string 108 and a wall of the bore hole 104. The drilling fluid then carries cuttings from the bottom of the bore hole 104 to the wellhead, where the cuttings are removed and the drilling fluid may be returned to the drilling fluid reservoir 132. A measurement system 136 is in communication with the drilling fluid system to measure data pulses in the drilling fluid, thus receiving data signals produced by the telemetry assembly 124.

Figure 2A:
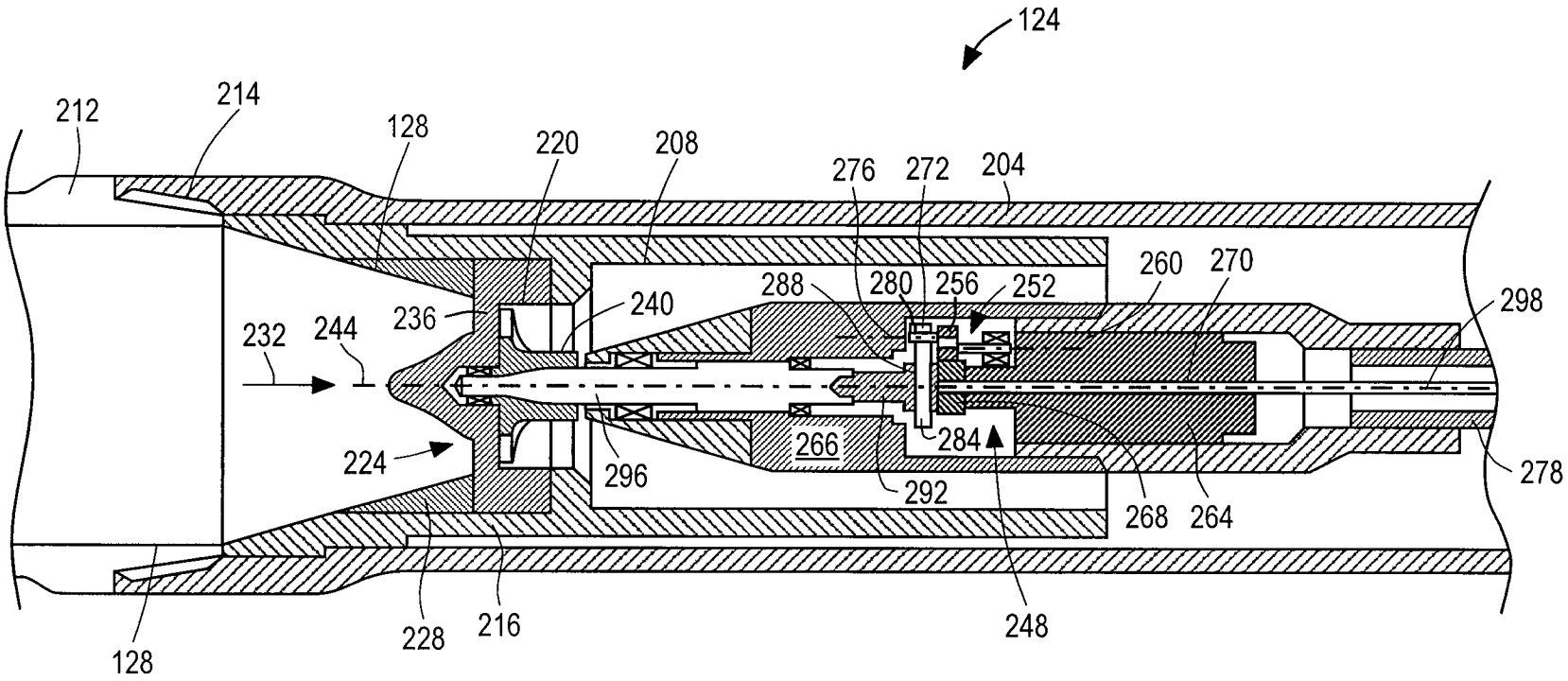
FIGS. 2A-2B depict an axial section of part of a telemetry assembly as a portion of a bottom hole assembly in a drill string, such as that depicted in FIG. 1, the telemetry assembly including an example shear valve and reciprocation mechanism to actuate angular reciprocation of the shear valve.

FIG. 2 shows a more detailed view of the example embodiment of the telemetry assembly 124. The telemetry assembly 124 includes an elongated generally tubular housing 204 that is connected in-line in the drill string 108, so that a hollow interior 208 of the housing 204 forms a portion of the fluid conduit 128 of the drill string 108. To this end, the housing 204 is connected to sections 212 of the drill string 108 at its opposite ends. In the example embodiment of FIG. 2A, the housing 204 is shown as being connected to an adjacent pipe section 212 by a threaded box joint coupling 214.

The housing 204 includes a sleeve body 216 that is received coaxially in the housing 204 at its upper end, the sleeve body 216 defining a valve passage 220 in the fluid conduit 128. A rotary valve or shear valve 224 is mounted in the valve passage 220 to alternately clear or obstruct the valve passage 220, thereby to generate data pulses in drilling fluid in the fluid conduit 128. As used herein, "obstruction" of a passage or port does not necessarily mean that flow through the passage or port is fully blocked, but includes partial blocking of flow. The fluid conduit 128 and the valve passage 220 are generally cylindrical, having a circular cross-sectional outline. However, the fluid conduit 128 includes a funnel section 228 that narrows progressively towards the valve passage 220 in a downstream direction (indicated by arrow 232).

Figure 7A:
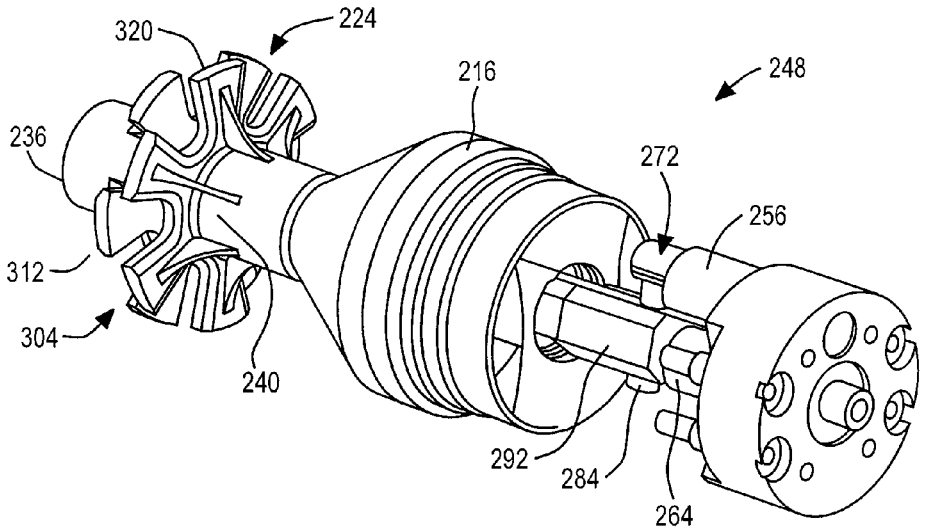
FIGS. 7A-7C is an isolated three-dimensional view of a valve and a reciprocation mechanism that may form part of a telemetry assembly, such as that depicted in FIGS. 2A-2B.

The valve 224 comprises a stator 236 that is located in the valve passage 220 and is rigidly connected to the housing 204, in this example being connected to the sleeve body 216. The valve 224 further comprises a rotor or valve member 240 that is mounted adjacent to the stator 236 for oscillating or reciprocating movement to alternately clear and obstruct the valve passage 220. The configuration of the stator 236 and the valve member 240 of the example embodiment of FIG. 2 can be seen with reference to FIGS. 3A and 3B, which shows an axial end view of the valve 224, with the valve member 240 being in an open position and in a closed position respectively, as well as in the FIGS. 7A and 7B, which shows a three-dimensional view of the valve 224 in the closed position and the open position respectively.

The stator 236 defines a circumferentially extending series of valve openings or ports 304 that lie in a plane more or less perpendicular to the lengthwise direction of the drill string 108. In the example embodiment of FIGS. 3A and 3B, each of the ports 304 is roughly trapezoidal in shape, comprising a sector of the stator's circumference. Each port 304 thus extends from a central hub 308 of the stator, being radially open ended, and being bordered by opposite radially extending side edges. In this embodiment, the ports 304 are regularly spaced, with the angular spacing between opposite side edges of one of the ports 304 being equal to the angular spacing between adjacent side edges of neighboring ports 304. The stator 236 has six ports 304 defining respective 30° angles, and being spaced apart at regular 30° intervals. The ports 304 of the stator 236 are thus interspersed with identically shaped and sized webs or tongues 312. An axial end face 316 of the stator 236 is flat (as shown) and is perpendicular to the stator's central axis, which defines a valve axis 244 (see also FIG. 2). The particular configuration of the valve 224 described with reference to FIGS. 2-5 and 7 may be different in other embodiments without departing from the scope of the disclosure. For example, the stator 236 may have fewer or more than six ports, and may be spaced apart at intervals that are greater or smaller than the exemplary 30° interval. The opposing axial end faces of the stator 236 and the valve member 240 may further, for example, not be flat and may intersect the valve axis 244 at an angle other than 90°.

The valve member 240 is complementary to the stator 236, defining a circumferentially extending series of vanes or blades 320 that is similar in shape, size, and relative spatial arrangement to the ports 304 of the stator 236. The valve member 240 in the present example therefore has six blades 320 radiating from a central hub 308, each blade 320 having a constant angular width of 30°, and the blades 320 being regularly spaced apart at intervals of 30°. The blades 320 have a radial length equal to that of the ports 304. The valve member 240 has an axial end face 324 (see FIG. 2) that is flat (as shown) and is closely axially spaced from the end face 316 of the stator 236, so that the stator 236 and the valve member 240 are arranged face-to-face with an axial working gap between them, the valve member 240 being coaxial with the stator 236 and being partially rotatable or angularly displaceable about the valve axis 244.

When the valve member 240 is in its open position (FIGS. 3A, 7B) the blades 320 are out of register with the respective ports 304, each blade 320 being in register with a corresponding tongue 312 of the stator, so that the ports 304 are fully cleared, to allow the flow of drilling fluid therethrough. When the valve member 240 is, however, in its closed position (FIGS. 3B, 7A), each of the blades 320 is in register with a corresponding port 304, fully obstructing the port 304 to block the flow of drilling fluid therethrough.

Returning now to FIG. 2, it will be seen that the telemetry assembly 124 further comprises a reciprocation mechanism 248 (see also FIG. 7A-7C) which is operatively connected to the valve member 240 to actuate angular or rotary reciprocation of the valve member 240 about the valve axis 244. The reciprocation mechanism 248 is provided downstream from the shear valve 224 and comprises a crank arrangement 252 in the example form of a crank wheel 256 which is mounted in the housing 204 to rotate about a crank axis 260 that is parallel to, and is transversely spaced from, the valve axis 244. The reciprocation mechanism 248 further comprises a drive arrangement in the form of motor 264 that is coaxially mounted in the housing 204 (as shown), being located downstream of the crank wheel 256. The motor 264 may include a turbine (not shown) to generate electrical power due to the flow of drilling fluid through the housing 204.

The motor 264 is drivingly connected to the crank wheel 256, to transmit rotation and torque to the crank wheel 256. In the present example embodiment, the motor 264 is connected to the crank wheel 256 by a gear transmission comprising a driven main gear 268 is in meshed engagement with the crank wheel 256, the crank wheel 256 being a gear wheel that is co-axial with the valve axis 244 (as shown).

A rigid slider member in the example form of a sliding pin or rod 272 is pivotally connected to the crank wheel 256 about a pivot axis 276 that is parallel to the crank axis 260 and the valve axis 244, being transversely spaced therefrom. To this end, a pivot pin 280 projects axially from the crank wheel 256 at a position radially spaced from the crank axis 260, so that the pivot axis 276 orbits the crank axis 260 upon rotation of the crank wheel 256. The pivot pin 280 is received spigot/socket fashion in a complementary cavity in the sliding rod 272 at a pivot end of the sliding rod 272 that is the radially outer end of the sliding rod 272, relative to the valve axis 244. Pivotal connection of the sliding rod 272 to the crank wheel 256 thus permits pivotal or angular displacement of the sliding rod 272 relative to the crank axis 260, but anchors the radially outer end of the sliding rod 272 to the pivot axis 260, to rotate with the pivot pin 280 about the crank axis 260.

The sliding rod 272 includes a shank 284 that is slidingly received in a complementary mating channel or bore 288 defined by a rocker in the example form of a yoke member 292. The yoke member 292 is attached to a driveshaft 296 that is, in turn, drivingly connected to the valve member 240, to transmit rotary movement and/or torque to the valve member 240. The bore 288 extends radially through the yoke member 292, intersecting the valve axis 244 (see also FIGS. 4A-4D). The bore 288 is cylindrical in shape (as shown), having a constant cross-sectional outline, and is complementary in cross-sectional outline to the shank 284, so that the shank 284 is a sliding fit in the bore 288. The shank 284 is thus keyed to the yoke member 292 for pivotal or angular displacement about the valve axis 244, while permitting radial sliding of the shank 284 in the bore 288. Because the sliding rod 272 is held captive by the complementary mating bore 288 such that it intersects the valve axis 244 regardless of the position of the pivot axis 276, driven rotation of the crank wheel 256 results in rotary or angular reciprocation of the shank 284 and the sliding rod 272 about the valve axis 244, consequently causing angular reciprocation of the yoke member 292, to which the sliding rod 272 is keyed for rotation, about the valve axis 244, as will be described in greater detail below. Angular reciprocation of the yoke member 292 is transferred to the valve member 240 via the driveshaft 296.

Figure 2B:
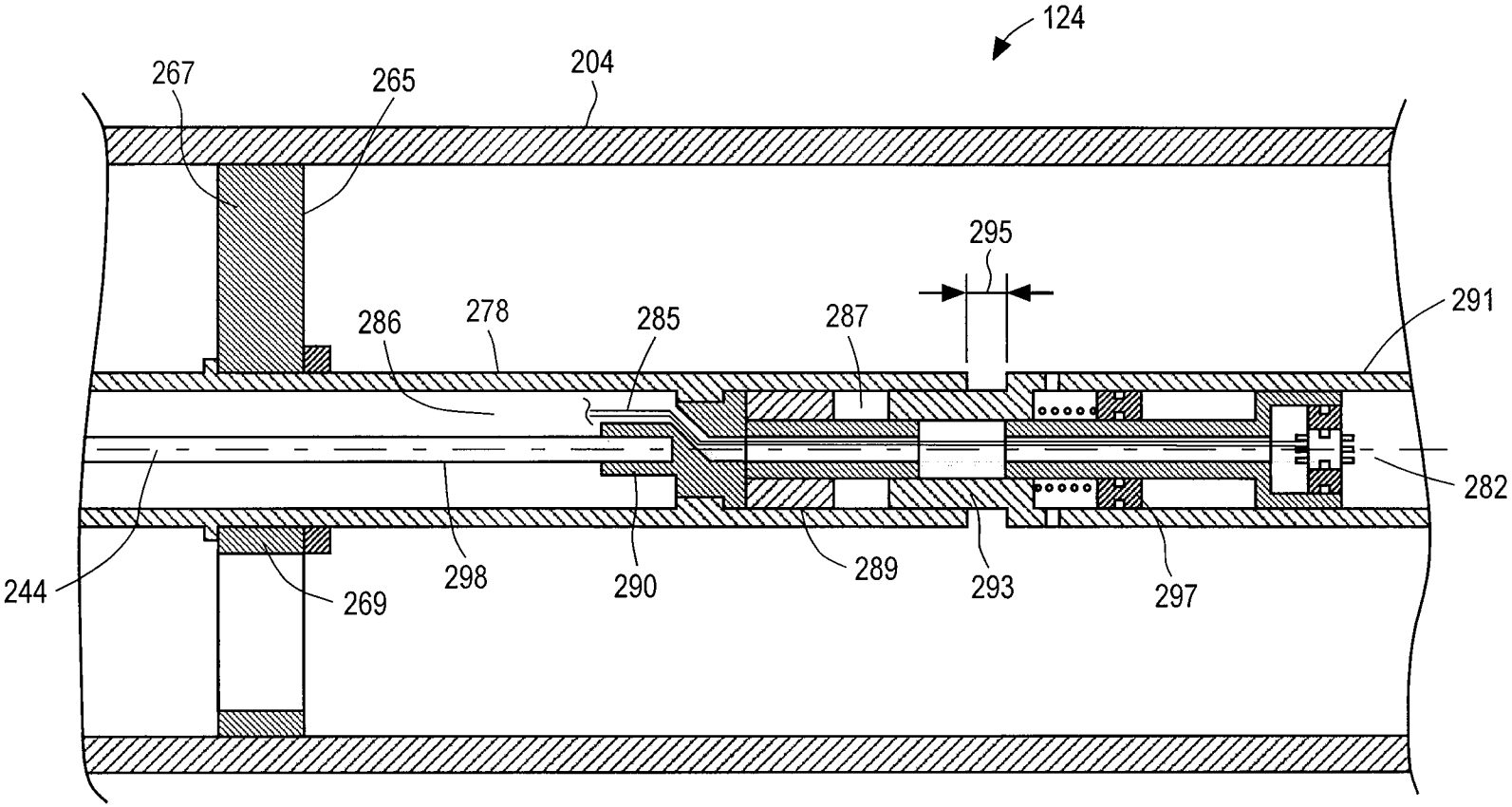

The reciprocation mechanism 248 further includes a torsion member in the form of a torsion bar 298 that is rigidly connected to the yoke member 292 (FIG. 2A) and extends coaxially from its connection to the yoke member 292 to a fixed connection at its other end (FIG. 2B). The upstream end of the torsion bar 298 is rotationally anchored to the yoke member 292 to be angularly displaceable with the yoke member 292 about the valve axis 244, while the downstream end 286 (FIG. 2B) of the torsion bar 298 is anchored against rotation relative to the housing 204 about the valve axis 244. As shown in FIG. 2B, the torsion bar 298 extends coaxially along a tubular drive housing or tube and is received in an anchor member 290 which is non-rotationally mounted in the housing 204.

The anchor member 290 clamps the downstream end 286 of the torsion bar 298 in position to anchor it against rotation. The downstream end of the assembly 124 also includes electrical controller inputs 282 to receive control signals from the measurement and control assembly 120, and to transmit the control signals to the motor 264. In this example the control signals are transmitted via electrical wires 285 that passes along the hollow interior of the tube 278. In other embodiments, the tube 278 may be a wired pipe and transmits electrical control signals. The torsion bar 298 is of a resilient material, in this example being of a suitable steel, so that the torsion bar 298 is torsionally resilient, to exert torque on the yoke member 292 resistive to angular displacement of the upstream end of the torsion bar 298 from an unstressed position. The torsion bar 298 is configured such that its unstressed position is located midway between opposite angular extremities of the yoke member's angular reciprocation. The torsion bar 298 thus serves as a torsion spring urging the yoke member 292 (and hence the valve member 240 to which it is attached) towards an angular position midway between opposite extremities of its actuated angular reciprocating movement (corresponding to the positions shown in FIGS. 4A and 4D respectively). The torsion bar's angular positional load scheme may be appropriately phased for operating conditions.

The torsion bar 298 is coaxial with the valve axis 244 and extends centrally through the motor 264 (FIG. 2A). To this end, the motor 264 defines an elongated circular cylindrical passage 270 coaxial with the valve axis 244, the torsion bar 298 extending co-axially through the passage with an annular working clearance.

The telemetry assembly 124 also includes motor control circuitry 266 in communication with the motor 264 and with the measurement and control assembly 120 via the electrical wires 285 (not shown in FIG. 2A, for clarity of illustration), to vary the speed of rotation of the crank wheel 256 responsive to control signals from the measurement and control assembly 120, in order to transmit data to the wellhead by modulating the data pulses generated by alternate opening and closing of the shear valve 224.

In operation, the crank wheel 256 is driven by the motor 264, causing the pivot axis 276, and therefore the pivot end of the sliding rod 272, to orbit the crank axis 260. Because the sliding rod 272 is constrained by the bore 288 of the yoke member 292 such that a lengthwise direction or longitudinal axis of the sliding rod 272 at all times intersects the valve axis 244, rotation of the pivot axis 276 about the valve axis 244 causes reciprocating angular or pivotal displacement of the sliding rod 272 about the valve axis 244 simultaneous with sliding of the sliding rod 272 lengthwise in the bore 288. A single stroke of the crank wheel 256 is illustrated in FIGS. 4A-4D. The transverse spacing between the pivot axis 276 and the crank axis 260, and the transverse spacing between the valve axis 244 and the crank axis 260 are selected such that the range of angular reciprocation of the sliding rod 272, and therefore of the valve member 240, is 30° for this instance. The angular displacement of the sliding rod 272 about the valve axis 244 for a quarter stroke of the crank wheel 256 (e.g., the difference in angular orientation of the sliding rod 272 between FIG. 4A and FIG. 4B) is 15° for this instance. The range of motion of the reciprocation mechanism 248, and the number of blades 320 of the valve member 236, may, in other embodiments, be different from that described with reference to the example embodiment of FIGS. 2-4.

Figure 3A:
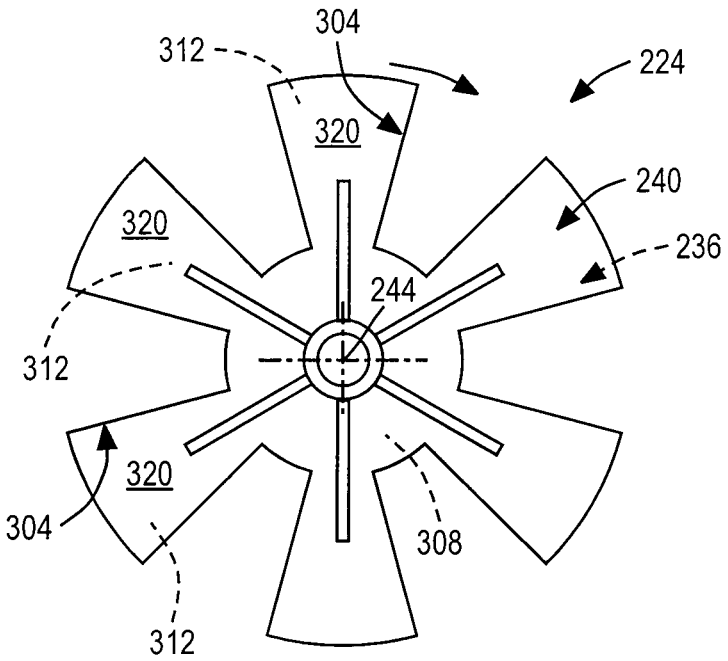
FIGS. 3A-3B depict an isolated end view of an example shear valve that may form part of a telemetry assembly such as that depicted in FIG. 2, the shear valve being shown in an open position in FIG. 3A and in a closed position in FIG. 3B.
Figure 7B:
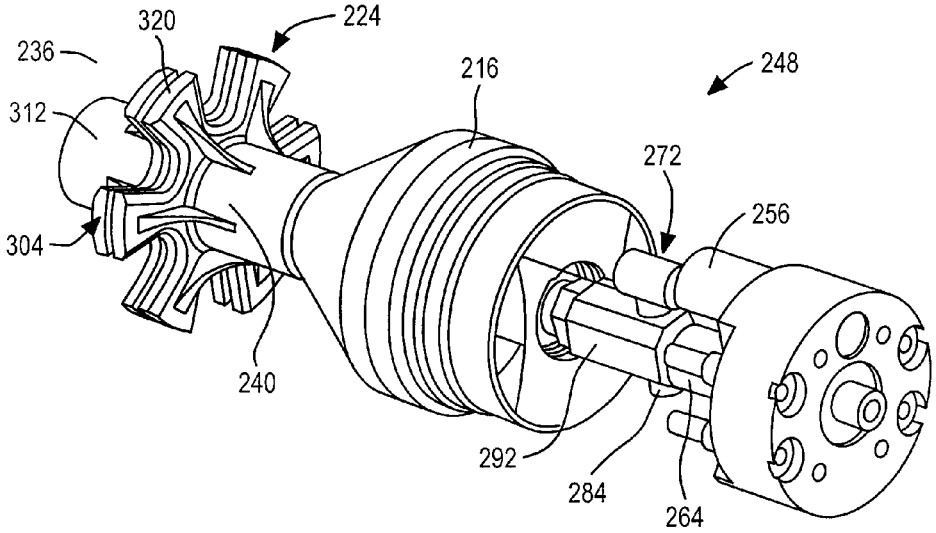
Figure 7C:
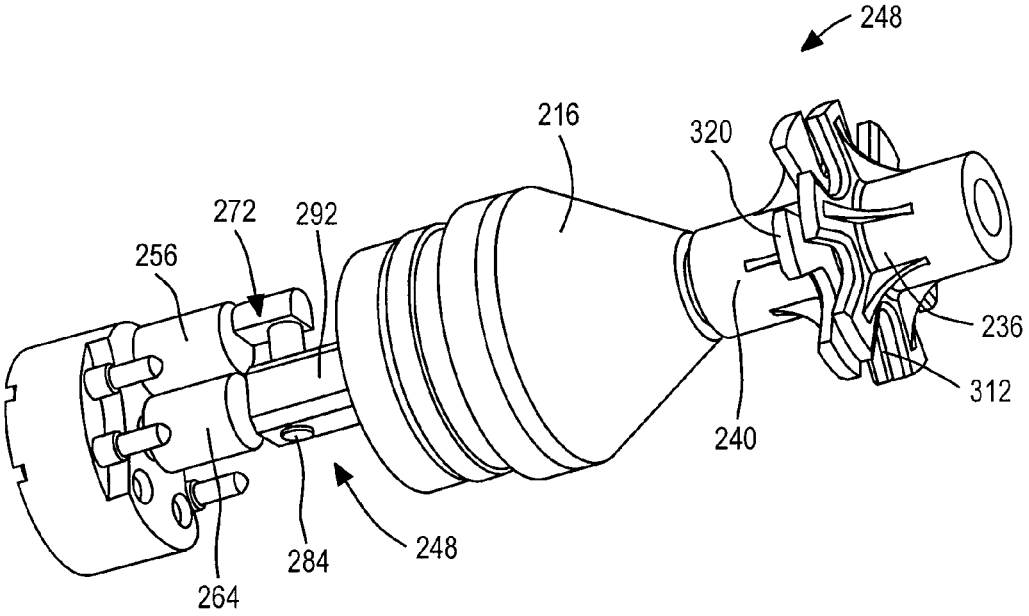

The valve member 240 is operatively connected to the reciprocation mechanism 248 such that the shear valve 224 is closed when the sliding rod 272 and the yoke member 292 is at one extremity of its angular movement, and is open when the sliding rod 272 and the valve member 240 is at the other extremity of its angular reciprocating movement. Thus, for example, the valve member 240 may be in its closed position (see FIG. 3B) when the yoke member 292 is at a maximum positive angular displacement (see FIGS. 4A, 7A), and may be in its open position (see FIG. 3A) when the yoke member 292 is at a maximum negative angular displacement (see FIGS. 4B, 7B). A single stroke of the crank wheel 256 thus actuates movement of the valve member 240 from a fully open position (FIGS. 3A, 7B) to a fully closed position (FIGS. 3B, 7A) and back to a fully open position (FIGS. 3A, 7B). The frequency of reciprocation or oscillation of the valve member 240, as described above, may be such that each stroke or cycle may be about 10 ms.

Figure 3B:
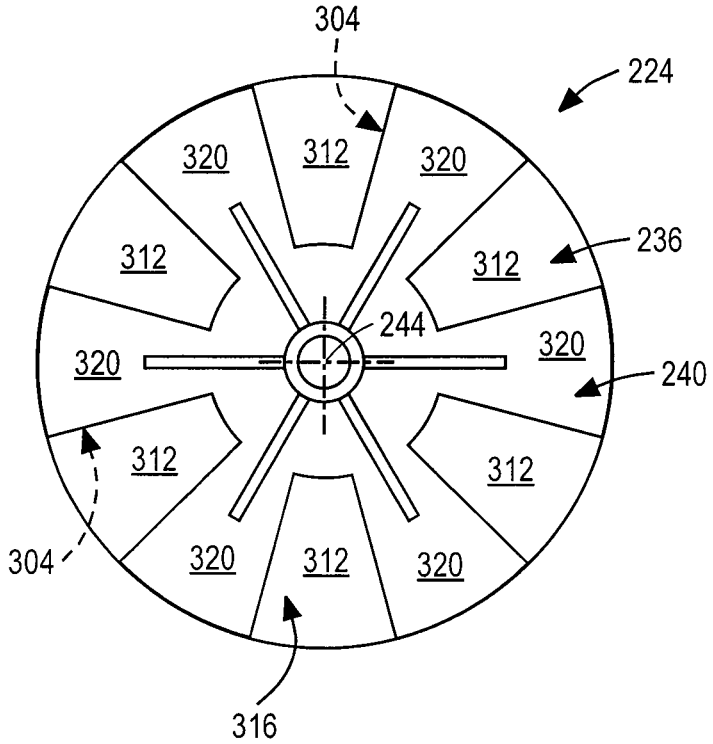
Figure 4A:
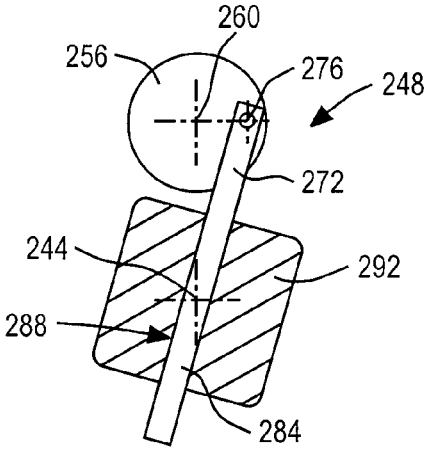
FIGS. 4A-4D depict an isolated cross-section of part of a reciprocation mechanism to form part of a telemetry assembly such as that depicted in FIG. 2, illustrating sequential positions of the reciprocating mechanism during a single reciprocation cycle.
Figure 4B:
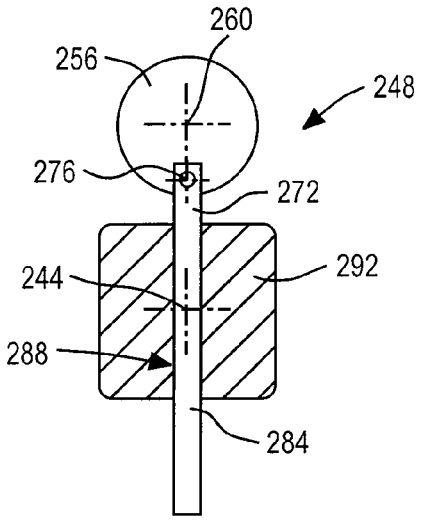
Figure 4C:
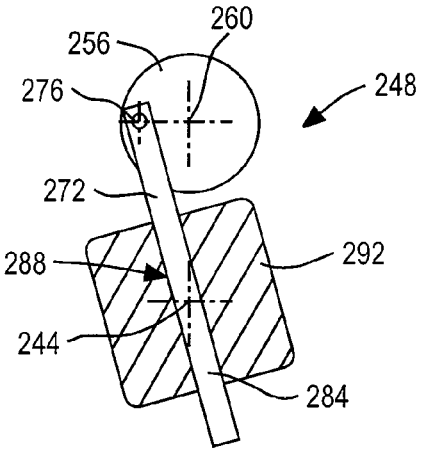
Figure 4D:
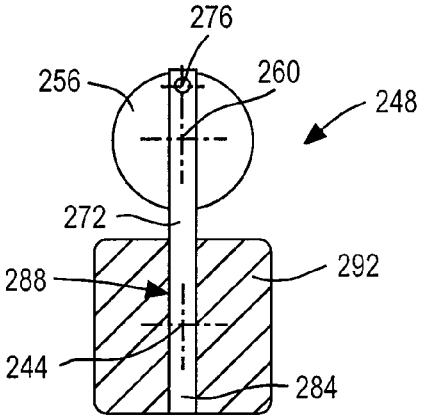

In the present example embodiment, the torsion bar 298 is configured such that it is in an unstressed state when the yoke member 292 is midway between the extremities of its angular reciprocating movement (see FIGS. 4B and 4D). Torque exerted by the torsion bar 298 on the yoke member 292 is thus at a maximum at the extremities of the yoke member's reciprocating angular movement. Such resilient exertion of torque by the torsion bar 298 on the yoke member 292, and therefore on the valve member 240, assists acceleration of the valve member 240 from momentarily stationary positions at the opposite ends of its movement, i.e. from its fully open position (FIG. 3A) and its fully closed position (FIG. 3B). In other embodiments, different angular positional load arrangements for the torsion bar 298 may be employed.

The telemetry assembly 124 may include a clutch (not shown) between the yoke member 292 and the valve member 240 to provide automatic disengagement between the yoke member 292 and the valve member 240 in the event of clogging of the valve 224 during closing, and automatically to re-engage on a return stroke after clogging. When the valve member 240 is for example blocked from closing by material caught between the valve member 240 and the stator 236, an excess torque situation may be created, causing automatic disengagement of the clutch to stop further movement of the valve member 240 to its closed position. Meanwhile, the yoke member 292 continues reciprocation, the clutch re-engaging upon return movement, to move the valve member 240 back to its open position. Operation of the clutch thus facilitates cleaning of the valve passage 220.

The assembly 124 may further include an amplitude modification system to dynamically change the amplitude of data pulses produced by the valve 224. For example, an axial actuating arrangement may be provided to actuate axial displacement of the valve member 240 relative to the stator 236, thus varying an axial gap between the valve member 240 and the stator 236. The axial spacing between the stator 236 and the valve member 240 may further be automatically controlled to adjust pulse amplitude for varying parameters of the drilling fluid, e.g. flowrate, mud weight and viscosity, drilling depths, etc . . . . An example axial actuating arrangement is illustrated in FIG. 2B as forming part of the telemetry assembly 124 and is described in greater detail below. In some embodiments, however, axial actuation of the valve member 224 may be omitted, so that data pulse signal modulation is controlled exclusively by controlling angular movement of the valve member 224.

The axial actuating arrangement includes a drive screw 287 that is coaxially mounted in the shield tube 278. The drive screw is drivingly connected to an adjustment motor 289 housed in the shield tube 278, upstream from the drive screw 287 relative to the fluid flow direction 232. An anchored housing 291 is positioned downstream from the shield tube 278, and is telescopically connected to the shield tube 278. To this end, the anchored housing 291 has a hollow tubular spigot formation 293 at its upstream end, the spigot formation being slidably received, spigot/socket fashion in an open downstream end of the shield tube 278. The shield tube 278 (and with it the torsion bar 298, the reciprocation mechanism 248, and the valve member 240) is axially slidable relative to the anchored housing 291, the anchored housing 291 having a fixed axial position relative to the housing 204 of the drill string 108. The drive screw 287 is screwingly engaged with an internal screw thread in the spigot formation 293 to actuate axial displacement of the shield tube 278 and other components connected to it relative to the anchored housing 291, responsive to driving of the drive screw 287 by the adjustment motor 289.

An axial spacing 295 between a shoulder of the anchored housing 291 and the adjacent end of the shield tube 278 defines an adjustment gap indicative of a maximum additional axial displacement of the shield tube 278 (and hence of the valve member 240) in the downstream direction (232), towards the anchored housing 291. The anchored housing 291 may further include a spring-loaded oil compensation piston 297 in combination with an oil reservoir 299 internal to the anchored housing 291. The oil reservoir 299 is in fluid flow communication with the interior of the shield 278, so that the spring-loaded oil compensation piston 297 automatically compensates for changes in volume in the combined interiors of the shield tube 278 and the anchored housing 291 owing to telescopic displacement of these elements relative to one another.

The shield tube 278 is centered by a centralizer 265 comprising a plurality of spokes 267 (in this example three regularly spaced spokes) radiating outwards from a central collar 269 in which the shield tube 278 is slidingly located. Distal ends of the spokes 267 are fixed to an interior wall of the housing 204. Adjacent spokes 267 define between them axially extending openings for the passage of drilling fluid therethrough.

In use, the adjustment motor 289 is controlled by a control system via the electrical wires 285, to dynamically vary the axial position of the valve member 240 relative to the stator 236, thereby to vary the amplitude of data pulses produced by the valve 224. Driven rotation of the drive screw 287 effects axial displacement of the shield tube 278, and hence of the valve member 240, due to screwing engagement of the drive screw 287 with the screw threaded spigot formation 293 of the anchored housing 291. An advantage of the telemetry assembly 124 is that the reciprocation mechanism 248 facilitates application of greater torque to the valve member 240. Greater frequency of reciprocation, and consequent higher data transmission rates in mud pulse telemetry is thus achievable by use of the reciprocation mechanism 248. Sliding contact between the sliding rod 272 and the yoke member 292 further promotes durability of the reciprocation mechanism, particularly when contrasted with reciprocation mechanisms that may, for example, include a cam mechanism employing point contact or line contact.

Figure 5A:
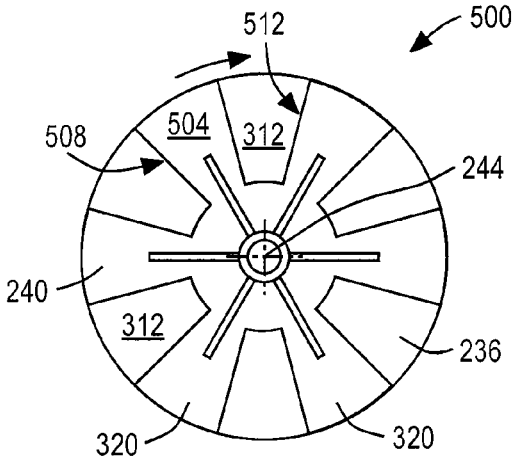
FIG. 5 depicts an isolated end view of a further example shear valve that may form part of a telemetry assembly, illustrating movement of the valve from a first closed position to a second closed position during a single reciprocating stroke.
Figure 5B:
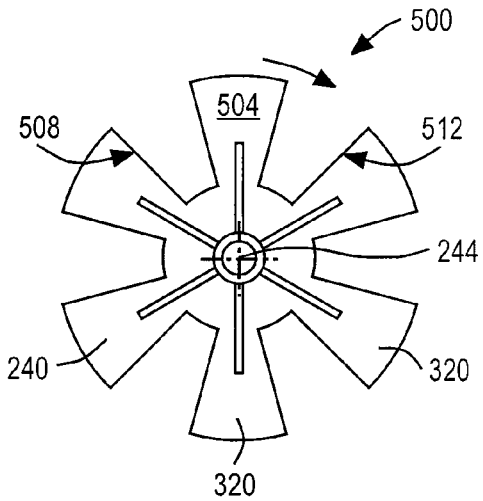
Figure 5C:
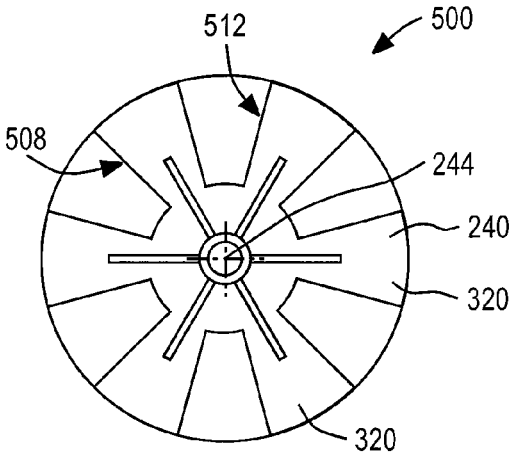

FIGS. 5A-5C show selected aspects of another example embodiment of a downhole telemetry assembly 500 that is configured to produce two data pulses per cycle or stroke. The assembly 500 is largely similar in construction and arrangement to the telemetry assembly 124 described with reference to FIGS. 2-4, with like components being indicated by like reference numerals in, on the one hand, FIGS. 2-4, and, on the other hand, FIG. 5. The assembly 500 may have a stator 236 and valve member 240 that are identical to those described above with reference to FIGS. 3A-3B. A reciprocation mechanism (not shown) of the assembly 500 is, however, configured to actuate rotary reciprocation such that each blade 320 of the valve member 240 closes two of the ports 304 of the stator 236 in a single cycle of its rotary reciprocation. In the example embodiment of FIG. 5A-5B the valve member is configured to be displaced +30° (FIG. 5A) and −30° (FIG. 5C) about a zero position (FIG. 5B) in which the blades 320 are clear of the respective ports 304. The valve member 240 thus has a range of angular displacement of 60°, moving in a single cycle from a first closed position (FIG. 5A) in which, for example, a particular blade 504 is in register with one of the ports 508, to a second closed position (FIG. 5C) in which the blade 504 is in register with a port 512 that neighbors the first port 508, and back to the first closed position (FIG. 5A). (This double action method may be described more easily by using same angular displacement but with double the blade quantities—it is more practical due to geometry limitations of mechanism envelope) Different arrangements of stator number and angular displacement range may be used to achieve the above-described double action in which two pulses per cycle are produced. For example, the reciprocation mechanism 248 described with reference to FIGS. 2A-B (i.e. having a range of angular displacement of 30°) may be employed in combination with double the number of regularly spaced blades and ports.

The reciprocation mechanism 248 described with reference to FIGS. 2-4 may be employed in the telemetry assembly 500, being altered to achieve the greater range of rotary reciprocation of the valve member 240 by, for example, decreasing a transverse spacing between the valve axis 244 and the crank axis 260, or by increasing radial spacing of the pivot axis 276 relative to the crank axis 260. In some embodiments, a different reciprocation mechanism may be employed to achieve actuation of rotary reciprocation of the valve member 240 such that the valve member closes two of the ports 304 in a single cycle or stroke.

An advantage of the arrangement described with reference to FIGS. 5A-5C is that a higher rate or frequency of data pulses may be achieved by a double-pulse cycle.

Figure 6:
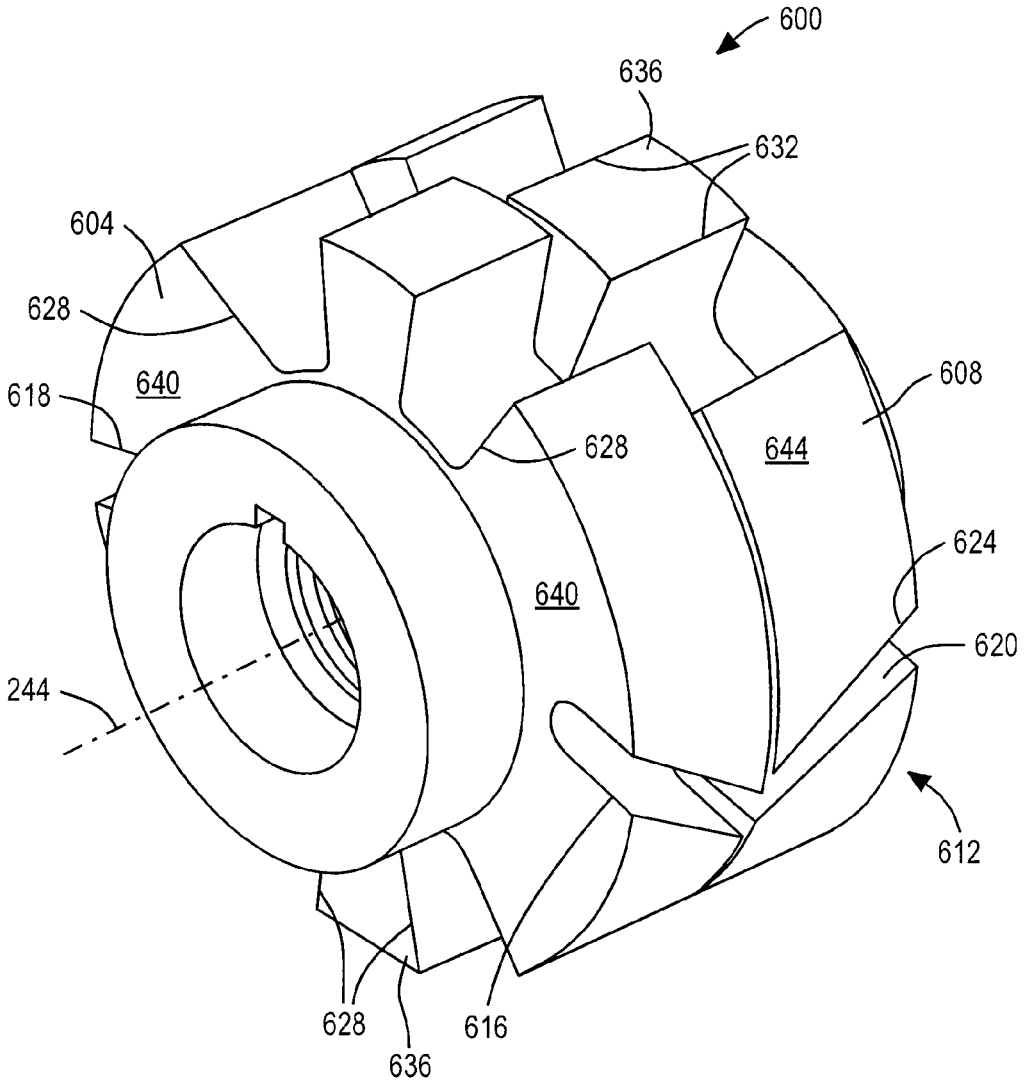
FIG. 6 depicts an isolated three-dimensional view of yet a further example shear valve that may form part of a telemetry assembly, the shear valve comprising an example torque assist arrangement.

FIG. 6 shows a further example embodiment of a valve 600 that may form part of a telemetry assembly similar to the telemetry assembly 124 described with reference to FIGS. 2-4. Like reference numerals indicate like parts in FIGS. 2-4 and in FIG. 6, unless otherwise indicated. The valve 600 of FIG. 6 comprises a stator 604 and a rotor or valve member 608 that includes a torque assist arrangement 612 to harness kinetic energy or pressure in the drilling fluid to impart torque to the valve member 608. The torque assist arrangement 612 includes a pair of openings or slits 616, 618 that extend axially through the stator 604 to direct drilling fluid on to impingement surfaces 620 provided by apertures or channels 624 (only one of which is visible in FIG. 6) that extend axially through the valve member 608.

The valve 600 is configured to produce a double pulse per stroke, similar to the assembly 500 of FIG. 5. The stator 604 defines two diametrically opposed pairs of ports 628. Each of the ports 628 in the example embodiment of FIG. 6 has an angular width of 30°, and the ports 628 of each pair are spaced apart by 30°. The valve member 608 has an arrangement of flow openings 632 which are identical in size and spacing to the ports 628, so that a vane or blade 636 is defined between the flow openings 632 of each pair of ports 628. Solid webs 640, 644 extend circumferentially between the pairs of ports 628 and flow openings 632 of the stator 604 and the valve member 608, respectively, so that when one of the blades 636 of the valve member 608 is in register with either of the associated ports 628, the flow of drilling fluid through the ports 628 is blocked by the valve member 608. A reciprocation mechanism (not shown) connected to the valve 600 is configured to actuate rotary reciprocation of the valve member about the valve axis 244 with a range of 30°, such of that a single stroke of the valve member 608, in use, moves the valve member 608 from a first closed position in which each of the blades 636 is in register with one of the ports 628 of the associated pair of ports 628, to a second closed position in which each blade 636 is in register with the other one of the ports 628 of the associated pair, and back to the first closed position.

The torque assist arrangement 612 is configured to provide the exertion of flow assisted torque to the valve member 608 in advance of full closing of the ports 628 by the valve member 608. The relative circumferential positions of, on the one hand, the radially extending slits 616, 618 in the stator 604, and, on the other hand, the matching radially extending channels 624 in the valve member 608, are such that a first one of the channels 624 is brought into register with its corresponding slit 616 when the valve member 608 is adjacent its first closed position, while the second one of the channels 624 is brought into register with its corresponding slit 618 when the valve member 608 is adjacent its second closed position. FIG. 6, for example, shows a position in which the first channel 624 is in register with the first slit 616 while the valve member 608 is about 5° from its first closed position. When the first channel 624 is thus exposed to the flow of drilling fluid, the second channel 624 is out of register with its corresponding slit 618, so that the flow of drilling fluid into the second channel 624 is blocked by the web 640 of the stator 604. Likewise, when the second channel 624 is in register with its corresponding slit 618, the valve member 608 being about 5° from its second closed position (i.e. when the valve member 608 is in a position spaced 50° in a clockwise direction from its position shown in FIG. 6), the first channel 624 is obstructed by the stator 604. Again, the relative positions of the torque assist arrangement may vary for different blade geometries and blade opening angles.

A circumferential or angular spacing between the channels 624 may be greater than the difference between, on the one hand, the angular spacing between the channels 624, and, on the other hand, the range of reciprocation of the valve member 608, to achieve alignment of one of the slits 616, 618 with an associated one of the channels 624 somewhat out of phase with each of the closed positions. In another example embodiment in which the range of angular reciprocation is 15° and the slits 616, 618 are hundred and 80° apart, the spacing between the channels 624 may be 160°, to achieve a 5° lead to fluid assisted torque application prior to closure. In other embodiments, angular spacing between the slits 616, 618 may be smaller than that the angular spacing between the channels 624.

Each of the slits 616, 618 is inclined relative to the valve axis 244 (see FIG. 6), extending both axially and circumferentially, to provide a circumferential component to drilling fluid flowing axially therethrough, thereby to direct the drilling fluid onto the corresponding impingement surface 620 in a partially circumferential direction. Each impingement surface 620 may likewise have an orientation which is inclined, when the impingement surface is viewed in axial section, relative to the associated slit 616, 618. Each impingement surface 620 may thus have an orientation which has a circumferential component, being inclined relative to the valve axis in a direction opposite to the orientation of the associated slit 616, 618. For clarity of description, alignment or registering of a slit 616, 618 with its associated channel 624 means that the valve member 608 is in a position where the slit 616, 618 and channel 624 are in fluid flow connection, e.g. when an outlet opening of the slit 616, 618 on a downstream axial end face of the stator 604 is in register with an inlet opening of the channel 624 on an opposing upstream axial end face of the valve member 608.

In use, the first slit 616 is brought into register with the associated channel 624 as the valve member 608 approaches the first closed position. Alignment of the slit 616 and the channel 624 results in the flow of drilling fluid under pressure through the slit 616 and on to the impingement surface 620, impinging on the impingement surface to exert a torque on the valve member 608 to assist closing of valve by movement of the valve member 608 to its first closed position. The opposite slit/aperture pair 618,624 functions in a similar manner to provide flow assisted torque to the valve member 608 shortly before closing of the valve member 608 by movement of the valve member 608 to the second closed position. To provide torque in opposite directions for closing to the first position and the second position respectively, the two slits 616, 618 may be inclined in the same direction relative to the valve axis 244. The two impingement surfaces 620 may likewise be inclined in the same direction as each other relative to the valve axis 244, being inclined oppositely relative to the slits 616, 618.

An advantage of the valve 600 illustrated with reference to FIGS. 6 and 7 is that it utilizes pressurized drilling fluid to apply torque to the valve member, in order to assist closing of the valve member 608. Applicants have found that maximum torque application to the valve member 608 is required at or approaching closing of the valve member 608. Timing application of flow assisted torque by the flow assist arrangement 612 to be slightly out of phase with closing of the valve member 608 thus advantageously reduces maximum torque required by the reciprocation mechanism 248, enabling greater reciprocation frequency and/or reducing wear on reciprocation mechanism components.

Thus, a method and system to perform analysis of a process supported by a process system have been described. Although the present invention has been described with reference to specific example embodiments, it will be evident that various modifications and changes may be made to these embodiments without departing from the broader spirit and scope of method and/or system. Accordingly, the specification and drawings are to be regarded in an illustrative rather than a restrictive sense.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An assembly to produce data pulses in a drilling fluid in a drill string, the assembly comprising:

a housing having a hollow interior, the housing being connectable to the drill string to place a valve passage defined by the hollow interior of the housing in fluid flow communication with a drilling fluid conduit defined by the drill string;

a shear valve mounted in the valve passage to produce data pulses in the drilling fluid by varying obstruction by the shear valve of the valve passage, the shear valve comprising a valve member which is angularly displaceable about a valve axis that is longitudinally aligned with the drill string, to vary obstruction of the valve passage; and a reciprocation mechanism operatively connected to the valve member to actuate angular reciprocation of the valve member about the valve axis, the reciprocation mechanism comprising:

a rocker that is drivingly connected to the valve member, the rocker being mounted to be substantially coaxial with the valve axis and to be angularly displaceable about the valve axis, a driven crank arrangement mounted to rotate about a crank axis substantially parallel to and transversely spaced from the valve axis, and a slider member which extends radially between the driven crank arrangement and the rocker, the slider member coupled to provide a sliding coupling between the driven crank arrangement and the rocker, the slider member pivotally connected to the driven crank arrangement, the slider member keyed to the rocker for angular displacement about the valve axis, and the slider member coupled to be radially slidable relative to the rocker, so that angular reciprocation of the slider member about the valve axis due to rotation of the driven crank arrangement results in angular reciprocation of the rocker and hence of the valve member.

2. The assembly of claim 1, wherein the rocker defines a radial bore that extends radially therethrough, the slider member comprising a complementary mating shank which is slidingly received in the radial bore, the complementary mating shank and the radial bore having complementary peripheral outlines in cross-section.

3. The assembly of claim 1, wherein the driven crank arrangement comprises a crank wheel mounted to rotate about the crank axis, the slider member being pivotally connected to the crank wheel at a pivot axis which is parallel to and radially spaced from the crank axis, the pivot axis orbiting the crank axis upon driven rotation of the crank wheel.

4. The assembly of claim 1, further comprising a motor operably connected to the driven crank arrangement to drive the driven crank arrangement, the motor being mounted in the hollow interior such that the motor is located more or less centrally in the drilling fluid conduit defined in part by the hollow interior of the housing, when the housing is viewed in cross-section.

5. The assembly of claim 4, further comprising a torsionally resilient torsion member coaxial with the rocker and operatively connected to the rocker to transmit torque thereto, the torsionally resilient torsion member being anchored against rotation at a fixed end thereof furthest from the rocker, to exert torque on the rocker responsive to angular displacement of the rocker relative to the fixed end of the torsionally resilient torsion member.

6. The assembly of claim 5, wherein the torsionally resilient torsion member is connected to an end of the rocker furthest from the valve member, the torsionally resilient torsion member extending through a passage defined by the motor.

7. The assembly of claim 1, wherein the shear valve comprises a stator that defines a circumferentially extending series of ports, the valve member comprising a circumferentially extending series of blades that are complementary to the ports, such that angular displacement of the valve member about the valve axis displaces the valve member between an open position in which the respective blades clear corresponding ports to allow the flow of drilling fluid therethrough, and a closed position in which the respective blades are in register with the corresponding ports to obstruct the flow of drilling fluid through the ports.

8. The assembly of claim 7, wherein the blades and the ports are substantially identical in size and shape.

9. The assembly of claim 7, wherein the shear valve and the reciprocation mechanism are arranged such that a particular blade obstructs two or more of the series of ports in a single cycle of its angular reciprocation.

10. The assembly of claim 9, wherein angular spacing of the blades and the ports respectively, and a reciprocation angle of the valve member about the valve axis, are selected such that the particular blade is in register with one of the series of ports at one extremity of its angular reciprocation, and is in register with another one of the series of ports at the opposite extremity of its angular reciprocation.

11. The assembly of claim 7, further comprising an amplitude modification arrangement to dynamically vary an axial spacing between the stator and the valve member, thereby to vary an amplitude of data pulses produced by reciprocation of the valve member.

12. The assembly of claim 7, further comprising a torque assist arrangement to effect the exertion of torque on the valve member by the drilling fluid, to urge the valve member to the closed position, the torque assist arrangement comprising an impingement surface defined by the valve member and an opening extending axially through the stator to direct drilling fluid on to the impingement surface when the impingement surface is brought in to register with the opening in the stator.

13. The assembly of claim 12, wherein the opening and the impingement surface are positioned such that angular displacement of the valve member towards the closed position brings the opening to register with the impingement surface prior to reaching the closed position.

14. A valve mechanism comprising:

a stator defining at least one fluid flow port therethrough;

a valve member mounted adjacent the stator, and coupled to be pivotally displaceable about a valve axis between a closed position in which the valve member obstructs the at least one of a port of the stator, and an open position in which the valve member substantially clears the at least one fluid flow port of the stator;

a rocker that is drivingly connected to the valve member to transmit torque and/or pivotal displacement of the valve axis to the valve member, the rocker being pivotally displaceable about the valve axis;

a driven crank arrangement mounted to rotate about a crank axis substantially parallel to and transversely spaced from the valve axis; and a slider member which provides a sliding coupling of the driven crank arrangement to the rocker, the slider member connected to the driven crank arrangement to pivot about a pivot axis that orbits the crank axis upon rotation of the driven crank arrangement, the slider member slidably received in a complementary mating formation forming part of the rocker such that the slider member intersects the valve axis, the slider member keyed to the rocker for pivotal displacement about the valve axis, so that rotation of the driven crank arrangement causes actuation of reciprocating pivotal displacement of the rocker about the valve axis.

15. The valve mechanism of claim 14, wherein the complementary mating formation of the rocker comprises an elongated bore extending diametrically through the rocker, the slider member comprising a complementary mating shank which is slidingly received in the elongated bore.

16. The valve mechanism of claim 14, wherein the driven crank arrangement comprises a crank wheel mounted to rotate about the crank axis, the pivot axis about which the slider member is pivotally connected being to and radially spaced from the crank axis.

17. The valve mechanism of claim 14, wherein the stator defines a circumferentially extending series of fluid flow ports, the valve member being coaxial with the stator and comprising a circumferentially extending series of blades that are complementary to the ports, such that pivotal displacement of the valve member about the valve axis displaces the valve member between the open position in which the respective blades clear corresponding ports to allow the flow of fluid therethrough, and the closed position in which the respective blades are in register with the corresponding ports to obstruct the flow of drilling fluid through the ports.

18. The valve mechanism of claim 17, wherein the driven crank arrangement and the rocker are arranged such that a particular blade obstructs two or more of the series of ports in a single cycle of its pivotal reciprocation.

19. The valve mechanism of claim 14, further comprising a torque assist arrangement to effect the exertion of torque on the valve member by fluid flowing under pressure through the stator, to urge the valve member to the closed position, the torque assist arrangement comprising an impingement surface defined by the valve member and an opening extending axially through the stator to direct drilling fluid on to the impingement surface when the impingement surface is brought in to register with the opening in the stator.

20. A method to produce data pulses in a drilling fluid flowing through a drill string, the method comprising:

mounting a shear valve in a valve passage that forms part of a drilling fluid conduit provided by the drill string, the shear valve comprising a valve member which is angularly displaceable about a valve axis longitudinally aligned with the drill string, to vary obstruction of the valve passage;

mounting a reciprocation mechanism in the drill string such that the reciprocation mechanism is connected to the shear valve, the reciprocation mechanism comprising:

a rocker that is drivingly connected to the valve member to drive angular reciprocation of the valve member, the rocker mounted to be substantially coaxial with the valve axis and to be angularly displaceable about the valve axis, a driven crank arrangement mounted to rotate about a crank axis substantially parallel to and transversely spaced from the valve axis; and a slider member providing a sliding coupling between the driven crank arrangement and the rocker, the slider member connected to the driven crank arrangement to pivot about a pivot axis parallel to the crank axis, the slider member slidably received in a complementary mating formation forming part of the rocker such that the slider member intersects the valve axis, the slider member keyed to the rocker for angular displacement about the valve axis; and driving rotation of the driven crank arrangement such that the pivot axis orbits the crank axis, thereby actuating angular reciprocation of the rocker about the valve axis, to produce data pulses in the drilling fluid by varying obstruction of the valve passage by the valve member.

21. The method of claim 20, further comprising varying speed of rotation of the driven crank arrangement, to modulate a frequency of the data pulses.

22. The method of claim 20, wherein the shear valve comprises a stator defines a circumferentially extending series of fluid flow ports, the valve member being coaxial with the stator and comprising a circumferentially extending series of blades that are complementary to the ports, such that pivotal displacement of the valve member about the valve axis displaces the valve member between an open position in which the respective blades clear corresponding ports to allow the flow of fluid therethrough, and a closed position in which the respective blades are in register with the corresponding ports to obstruct the flow of drilling fluid through the ports.

23. The method of claim 22, wherein the driven crank arrangement and the rocker are arranged such that a particular blade obstructs two or more of the series of ports in a single cycle of its pivotal reciprocation.

24. The method of claim 22, further comprising exerting a flow assisted torque on the valve member by means of the drilling fluid flowing, to urge the valve member to the closed position.

25. The method of claim 24, wherein the exerting the flow assisted torque comprises bringing an impingement surface defined by the valve member into register with an opening extending axially through the stator, to direct drilling fluid flowing through the opening in the stator on to the impingement surface.

* * * * *